US005201080A

United States Patent [19]

Tanaka et al.

[11] Patent Number: 5,201,080

[45] Date of Patent: Apr. 13, 1993

[54] CLEANSING CONTROL APPARATUS

[75] Inventors: Eiichi Tanaka, Nara; Hiroshi Fujieda, Kashiwara, both of Japan

[73] Assignee: Matsushita Electric Industrial Co., Ltd., Osaka, Japan

[21] Appl. No.: 753,885

[22] Filed: Sep. 3, 1991

[30] Foreign Application Priority Data

Sep. 11, 1990 [JP] Japan ..... 2-242083
Sep. 11, 1990 [JP] Japan ..... 2-242084
Mar. 19, 1991 [JP] Japan ..... 3-54517

[51] Int. Cl.[5] ..... E03D 9/08; A61H 33/00

[52] U.S. Cl. ..... 4/443; 4/448

[58] Field of Search ..... 4/420.1, 420.2, 420.3, 4/420.4, 420.5, 443, 444, 445, 446, 447, 448; 134/56 R, 57 R, 52, 44; 128/66, 365, 366, 370, DIG. 7; 604/289

[56] References Cited

U.S. PATENT DOCUMENTS 4,630,322 12/1986 Kuo ..... 4/420.4
4,715,391 12/1987 Scheller ..... 134/57 R
4,726,388 2/1988 Swinehart et al. ..... 134/56 R X
4,799,686 12/1988 Taniguchi et al. ..... 4/420.4 X
4,860,178 8/1989 Picon ..... 4/661
4,903,347 2/1990 Garcia et al. ..... 4/420.4
4,933,997 6/1990 Kaneko ..... 4/420.4

FOREIGN PATENT DOCUMENTS

0167099A3 1/1986 European Pat. Off. .
0180236A3 5/1986 European Pat. Off. .

*Primary Examiner*—Henry J. Recla
*Assistant Examiner*—Charles R. Eloshway
*Attorney, Agent, or Firm*—Wenderoth, Lind & Ponack

[57] ABSTRACT

A cleansing control apparatus includes: a cleansing fluid projector for projecting a cleansing fluid; a position controller for controlling the position where the fluid from the cleansing fluid projector hits an aimed part; a pick-up part which monitors the color and brightness of the aimed part so as to thereby output an image signal, and a control part which outputs a control signal to the position controller so as to determine the position of the aimed part to be cleaned on the basis of the image signal from the pick-up unit, whereby it is possible to project a medicine, cleanser, toilet water, etc. different from the cleansing water from a second fluid projector, and the aimed part can be properly treated, for example, a wound of the aimed part can be healed or protected.

8 Claims, 4 Drawing Sheets

CLEANSING CONTROL APPARATUS

BACKGROUND OF THE INVENTION

1. Field of the Invention

The present invention relates to a cleansing control apparatus adapted to automatically control the amount, direction, angle, etc. of a fluid when the fluid such as cleanser, medicine or the like is jetted out to clean or sanitize an aimed part of one's rump.

2. Description of the Prior Art

A conventional cleansing control apparatus of the type referred to above, for instance, a control apparatus used in a toilet is designed to control opening and closure of a jet port having one or a plurality of opening holes, or to oscillate and move the position of the jet port to clean a predetermined area of the aimed part.

The jet port of the conventional control apparatus is preliminarily positioned and directed towards a point where the aimed part of the rump is supposed to be found after easing nature. The aimed part is made clean by opening the jet port and flushing the liquid to the aimed part.

However, in the above arrangement where the jet port is positioned at a fixed position, a flush of the liquid does not always hit the aimed part correctly since the position of the aimed part in the rump is different depending on the stature, age, and the like of the user. Therefore, the user is obliged to move the aimed part in the way of the gushing fluid. Moreover, the aimed part spreads a predetermined area, and it becomes necessary to move the rump during cleansing in order to clean up the whole aimed part desired to be cleaned.

In the meantime, such an approach is made to lessen the movement of the rump around the center of the aimed part such that a moving part which is able to change the position of the jet port from the standard position is provided in the control apparatus. The moving part is adapted to oscillate for every user.

However, any of the aforementioned arrangements is not capable of confirming the position of the aimed part, and since the fluid is jetted only to a predetermined point, the user is inconveniently required to move the aimed part by himself or herself.

In addition, a selection button must be used to switch the position of the jet port depending on whether the user is male or female or, excretes feces or urine. It is a troublesome to manipulate the button every time before use.

SUMMARY OF THE INVENTION

The object of the present invention is therefore to provide a cleansing control apparatus, with an aim to eliminate the above-described problems, whereby the position and area of an aimed part of one's rump are detected, thereby cleansing the aimed part without the necessity of moving the aimed part.

A further object of the present invention is to provide a cleansing control apparatus adapted to judge the gender of a user, thereby performing a suitable cleansing operation corresponding to the using circumstances.

A yet further object of the present invention is to provide a cleansing control apparatus designed to facilitate a remedy of an aimed part of one's rump with the flush of medicines if the part is wounded.

A still object of the present invention is to provide a cleansing control apparatus capable of projecting a fragrant agent to an aimed part of one's rump after easing nature, thereby improving the amenity.

In order to achieve the above-described objects, a cleansing control apparatus according to the present invention is provided with: a projecting means for projecting a cleansing fluid to an aimed part; a position controlling means for moving the projecting means to control the position where the fluid from the projecting means hits the aimed part; a pick-up part which outputs an image signal as monitoring the color and brightness of the aimed part hit by the fluid, and a control part which calculates the position of the aimed part on the basis of the image signal from the pick-up part and generates a control signal to the position controlling means.

The cleansing control apparatus of the present apparatus is further provided with a second projecting means for projecting a fluid different from the cleansing fluid, wherein the position where each fluid jetted from the cleansing fluid projecting means and second fluid projecting means hits the aimed part is controlled by the position controlling means, while the color and brightness of the aimed part which is receiving fluids from the cleansing fluid projecting means and second fluid projecting means is monitored by the pick-up part.

Moreover, a gender discriminating means is mounted in the cleansing control apparatus of the present invention, so that the user's sex is discriminated based on the image signal from the pick-up part.

In the cleansing control apparatus of the structure as described hereinabove, the pick-up part, which is monitoring the color and brightness of the aimed part, generates an image signal. The control part calculates the position of the aimed part based on the image signal from the pick-up part, and outputs a control signal to the position controlling means. In consequence, the position controlling means controls the position of the cleansing fluid projecting means, whereby a representative spot of the aimed part and the surrounding area around the representative spot are properly cleaned. The control part calculates the position of the aimed part based on the image signal from the pick-up part, and the position controlling means controls the position of the cleansing fluid projecting means and second fluid projecting means. After cleansing the aimed part, a medicine or a fragrant agent is projected from the second fluid projecting means, so that the aimed part is properly cleaned.

The gender discriminating means judges the user's gender on the basis of the image signal from the pick-up part. Subsequently, the pick-up part, outputs an image signal, based on which the control part judges the kind of excretion, that is, feces or urine. The position controlling means controls the position of the cleansing fluid projecting means, whereby a representative spot to be cleaned in the aimed part and the surrounding area are properly cleaned.

BRIEF DESCRIPTION OF THE DRAWINGS

These and other objects and features of the present invention will become clear from the following description taken in conjunction with preferred embodiments thereof with reference to the accompanying drawings throughout which like parts are designated by like reference numerals, and in which.

DETAILED DESCRIPTION OF THE PREFERRED EMBODIMENTS

Figure 1:
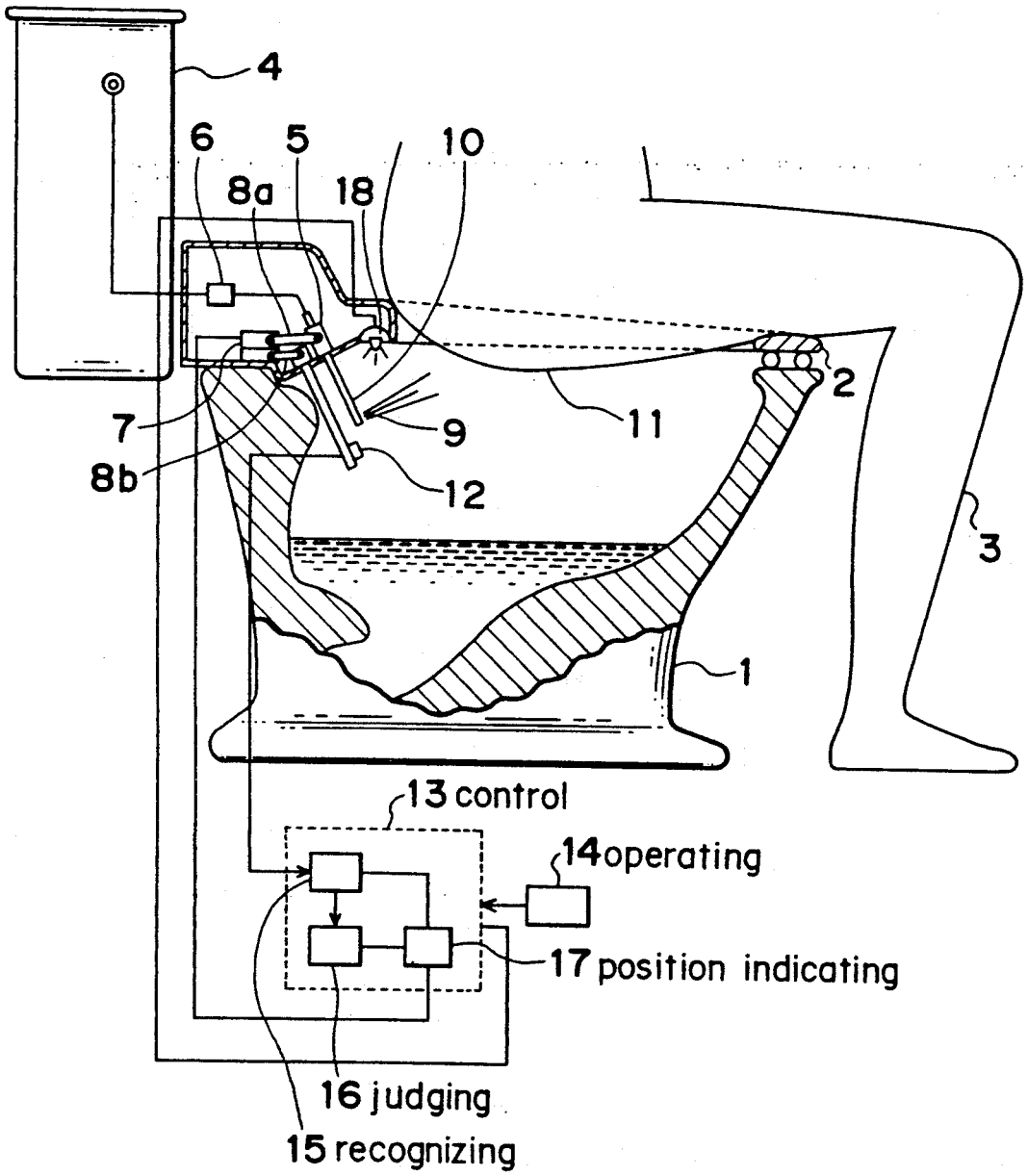
FIG. 1 is a diagram showing the structure of a cleansing control apparatus according to a first embodiment of the present invention.

A cleansing control apparatus of a first embodiment of the present invention will be depicted hereinbelow with reference to FIG. 1. In FIG. 1, reference numerals 1 and 2 represent a toilet and a seat for a user 3. A fluid from a cleansing water tank 4 is supplied to a nozzle 5 through an opening valve 6. The nozzle 5 is moved up and down and, right and left by a position controlling means 7 via a movable part 8*a*. A jet port 9 is formed in the vicinity of an end part of an extension 10 of the nozzle 5. The extension 10 is arranged to be projected and retracted from the toilet 1 by hydraulic pressure. FIG. 1 illustrates the state when the extension 10 is stretched to clean an aimed part 11. A pick-up part 12 mounted in the vicinity of the nozzle 5 monitors the aimed part 11 of the user 3. This pick-up part 12 is connected to the position controlling means 7 via a movable part 8*b*. The pick-up part 12 is brought to the position inside the toilet as in FIG. 1 when in use, and accommodated at a corner of the toilet when it is not used. The position controlling means 7 and pick-up part 12 are electrically connected to a control part 13. The control part 13 is constituted by a recognizing part 15 which recognizes the aimed part 11 from an image signal of the pick-up part 12 to start cleansing upon receipt of an order from an operating part 14, e.g. - a user operated start switch, a judging part 16 which judges the position and cleansing degree of the aimed part 11 based on the recognition by the recognizing part 15, and a position indicating part 17. The position of the aimed part 11 to be cleaned is taught to the position controlling means 7 from the position indicating part 17 in accordance with the recognition and judgement in the recognizing part 15 and judging part 16. An illuminating means 18 connected to the control part 13 illuminates the inside of the toilet 1 indirectly.

Figure 2:
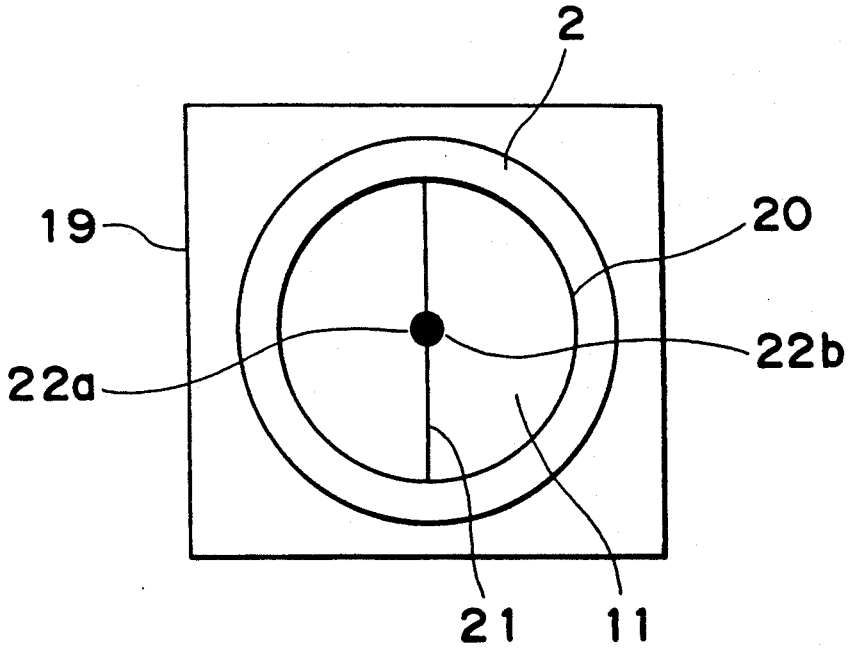
FIG. 2 is a diagram of an image recognized by the apparatus of FIG. 1.

The operation of the cleansing control apparatus of FIG. 1 will be described below. The illuminating means 18 is lit and the toilet is illuminated thereinside at the appropriate time of usage. The reason for the indirect lighting is to avoid generation of shadows. An image of the user (an aimed part of the rump) before use is picked up by the pick-up part 12, as shown in FIG. 2, and put into a memory of the recognizing part 15. The image is rendered an initial image 19. The initial image 19 is processed by spatial differential operations, so s to thereby detect the edges. Any method will do so long as only the edges of the image are extracted. As a result, a characteristic line of the binary image is obtained as indicated in FIG. 2. A center line 21 near the center of the seat 2 is obtained from a seat line 20 and further, a representative spot 22*a* in the aimed part 11 from which to excrete is searched from portions of thick lines around the center line 21. The recognizing part 15 detects the initial image data such as shape, color, etc. in the vicinity of the representative spot 22*a* thereby to recognize the image.

When the user 3 drives the operating part 14 after excretion, the current image is input into the recognizing part 15 from the pick-up part 12, where a representative spot 22*b* of the current image of the aimed part 11 is detected in the same manner as when the initial image is processed. At the same time, the recognizing part 15 extracts characteristics of edges in the periphery of the aimed part 11 with using the representative spot 22*b* as a reference point. Thereafter, the representative spot 22*b* of the current image (image after excretion) is moved to agree with the representative spot 22*a* of the initial image (image before excretion), that is, the current image is matched with the initial image, and the colors of the same points (representative spots) are compared with each other in the judging part 16. If the color difference is found, the aimed part has not yet been cleaned. In such a case, the opening valve 6 is opened to supply the fluid from the tank 4 to the nozzle 5. The extension 10 of the nozzle 5 is extended from the contracted state into the toilet 1 by hydraulic pressure in accordance with an order from the position indicating part 17, and the cleansing water is projected from the jet port 9. The representative spot is cleaned first according to the present invention. This procedure is continued until the judging part 16 confirms no color difference. Then, the area set by the recognizing part 15 is scanned spirally according to an order from the position indicating part 17. When the whole area is judged to have no color difference by the judging part 16, cleaning is determined to have been completed complete. The opening valve 6 is closed and the extension 10 is retracted from within the toilet 1.

Although the judging part 16 makes judgement based on the color difference in the above description, luminance information or the like may be used to find the change before and after cleansing. Moreover, the aimed part may be scanned from an end part thereof, not spirally.

Figure 3:
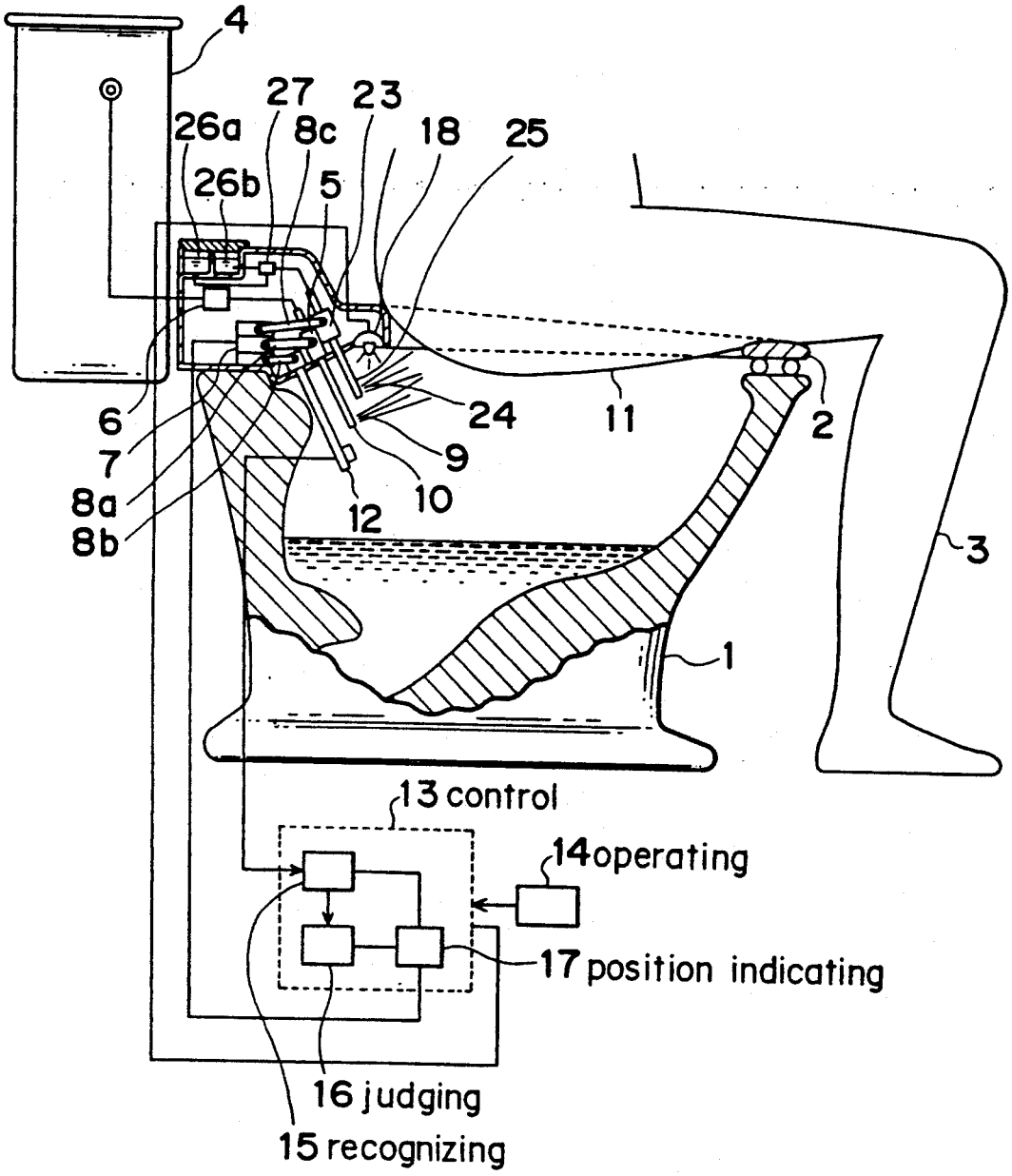
FIG. 3 is a diagram showing the structure of a cleansing control apparatus according to a second embodiment of the present invention.

A cleansing control apparatus of a second embodiment will be explained with reference to FIG. 3. In the structure shown in FIG. 3, the cleansing control apparatus is additionally provided with a second nozzle 23 connected to the position controlling means 7 via a movable part 8*c*. Besides, there are a jet port 24 formed in the vicinity of an end part of a second extension 25 of the second nozzle 23, second fluid tanks 26*a*, 26*b* for storing medicines, cleanser or toilet water, etc. to be supplied to the jet port 24, and a second opening valve 27 for opening/closing the path from the second fluid tanks 26*a*, 26*b* to the jet port 24 or switching the path. The cleansing control apparatus of the second embodiment is in the same structure as in FIG. 1 except for the aforementioned arrangement.

According to the second embodiment, the aimed part is cleaned totally in the same manner as in the first embodiment.

In the case where it is desired to clean the aimed part with the toilet water immediately after it is cleaned with the cleansing water, the toilet water stored in the second fluid tank 26*a* is supplied to the second nozzle 23 through the opening valve 27 opened in accordance with an instruction from the operating part 14. The second extension 25 of the second nozzle 23 is, following an instruction from the position indicating part 17, extended inside the toilet 1 by hydraulic pressure and moved via the movable part 8*c* to flush the toilet water from the jet port 24 to the aimed part 11.

Medicine can be used in place of the toilet water if the aimed part is afflicted with, for example, hemorrhoids. Since the wounded part is generally adjacent to the representative spot 22 where the excretion comes out, the position controlling means 7 is driven to the representative spot by the position indicating part 17, thereby to project the medicine stored in the second fluid tank **26*b* from the jet port 24**.

Figure 4:
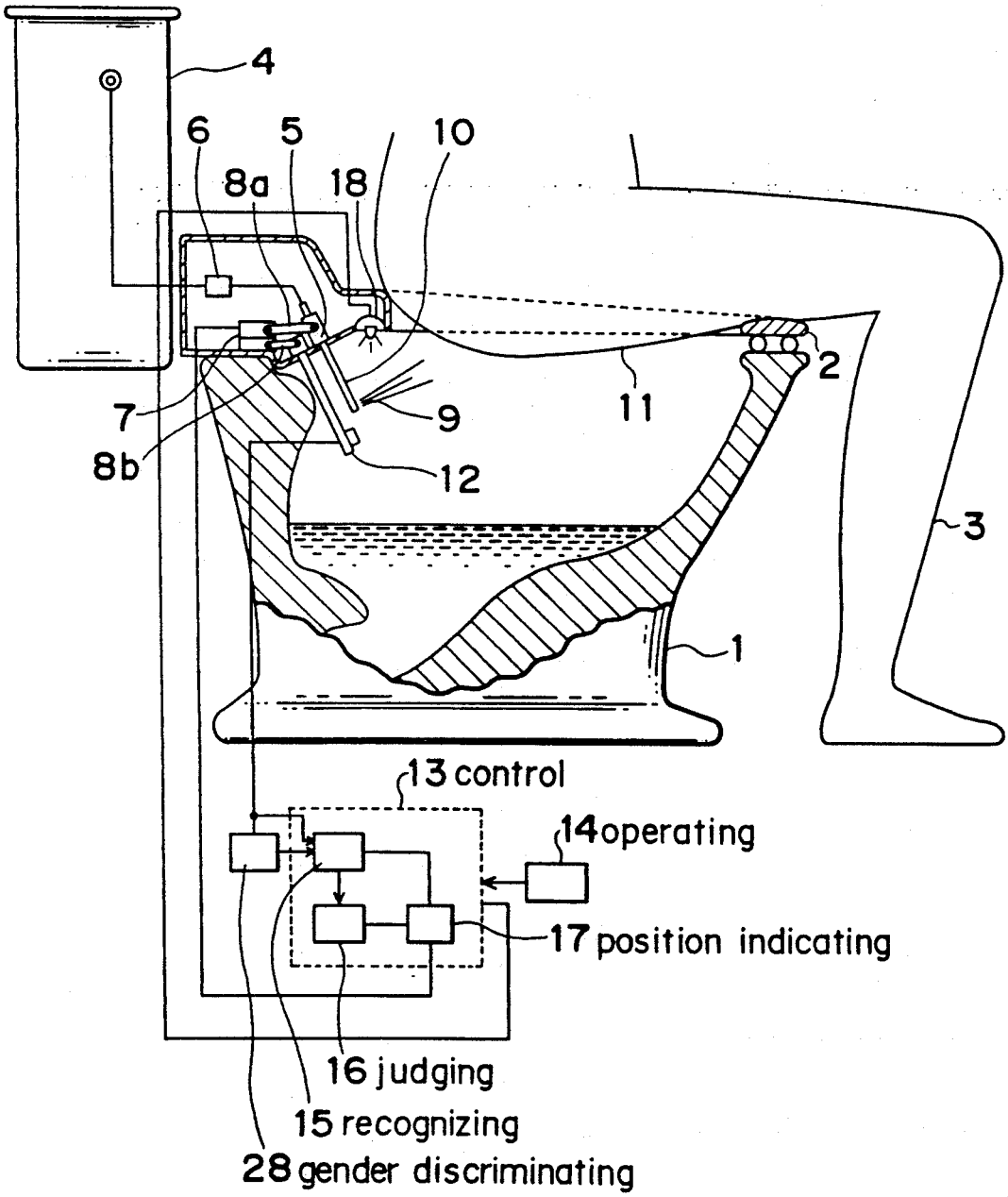
FIG. 4 is a diagram showing the structure of a cleansing control apparatus according to a third embodiment of the present invention.

A third embodiment of the present invention will be described with reference to FIG. 4. In FIG. 4, a cleansing control apparatus according to the third embodiment includes a gender discriminating part 28. An output from the pick-up part 12 provided in the vicinity of the nozzle 5 is connected to the gender discriminating part 28 and control part 13. And, an output of the gender discriminating part 28 is connected to the control part 13. Except for the gender discriminating part 28, the cleansing control apparatus of this third embodiment is formed in the same structure as in FIG. 1.

The cleansing control apparatus of the third embodiment operates in a manner as follows. When the user 3 sits on the seat 2, the illuminating means 18 is lit to illuminate the inside of the toilet. The illuminating means 18 illuminates the toilet indirectly in order to prevent shadows. Then, an image of the user (aimed part of the rump) before excretion is input into a memory of the recognizing part 15 from the pick-up part 12. Simultaneously, the image is input to the gender discriminating part 28. The gender discriminating part 28 processes the image to detect edges, etc., namely, to extract characteristics of the image. If the user is male, it is judged from the edge of the male sexual organ. A female user is judged by the absence of the male organ.

When the user is determined to be female, a bidet is operated as soon as no color difference is detected between the representative spot **22*a* of the initial image and the representative spot 22*b* of the current image. On the other hand, if the color difference is present, both the bidet cleansing and the anus cleansing are performed. When the gender discriminating part 28** judges the user as a male, only the anus cleaning is carried out.

As is made clear from the foregoing description of preferred embodiments, the cleansing control apparatus of the present invention provides the following merits;

(1) The aimed part is made clean through recognition of the dirt of the aimed part by an image, and therefore one push of a cleaning button is enough to clean the aimed part, without, the necessity of moving the rump in the way of the flushing fluid.

(2) Completion of cleaning is detected automatically, thereby saving the cleansing water, energy and time.

(3) Since it is possible not only to clean the aimed part, but to project medicines as a second fluid, the apparatus is utilizable to cure a wound of the aimed part such as hemorrhoids, etc.

(4) Toilet water can be flushed as a second fluid after the cleansing water is used, with improved hygienic effects.

(5) Since the target spot is already known from the image, the amount of medicines, toilet water or the like used can be minimized.

(6) Selection of buttons, e.g., for the cases of male feces, female feces or female urine is not required, thus realizing automatic cleaning.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A cleansing control apparatus for a toilet having a seat for a suer, the apparatus comprising:

a cleaning fluid projecting means for projecting a cleaning fluid;

a position controlling means for controlling the position where the fluid from said cleaning fluid projecting means hits an aimed part of a user when sitting on said seat;

a pick-up unit for monitoring the color and brightness of the aimed part; and a control unit for calculating the position of the aimed part to be cleaned on the basis of an image signal generated by said pick-up unit, and for inputting a control signal to said position controlling means.

2. A cleansing control apparatus according to claim 1, wherein said pick-up unit is adapted to be disposed in the toilet so as to freely project or retreat from the toilet, and includes a means for positioning it at a corner of the toilet when into in use.

3. A cleansing control apparatus according to claim 1, wherein the user has a gender, further comprising a geneder discriminating means for judging the genera of the user based on the image signal from said pick-up unit.

4. A cleansing control apparatus for a toilet having a seat for a user, the apparatus comprising:

a cleansing fluid projecting means for projecting a cleansing fluid;

a second fluid projecting means for projecting a fluid different from said cleansing fluid after the cleansing fluid is projected by the cleansing fluid projecting means;

position controlling means for controlling the position where each fluid from said cleansing fluid projecting means and second fluid projecting means hits an aimed part of a user when sitting on said said seat;

a pick-up unit for monitoring the color and brightness of the aimed pat, and for outputting an image signal; and a control unit for calculating the position of said aimed part to be cleaned and to be hit by the second fluid on the basis of the image signal from said pick-up unit, and for outputting a control signal to aid position controlling means.

5. A cleansing control apparatus according to claim 4, wherein said second fluid projecting means projects the fluid different from the cleansing fluid after the cleansing fluid projecting means projects the cleansing fluid.

6. A cleansing control apparatus according to claim 5, wherein the fluid projected from said second fluid projecting means is a medicine.

7. A cleansing control apparatus according to claim 4, wherein the fluid projected from said second fluid projecting means is a fragrant agent.

8. A cleansing control apparatus according to claim 4, wherein the user has a gender, further comprising as gender discriminating means or judging the gender of the user on the basis of said image signal from said pick-up unit.

* * * * *